US011390486B2

(12) United States Patent
Ha

(10) Patent No.: US 11,390,486 B2
(45) Date of Patent: Jul. 19, 2022

(54) WIRE REEL

(71) Applicant: ShinKyung Inc., Busan (KR)

(72) Inventor: Ki Ho Ha, Busan (KR)

(73) Assignee: SHINKYUNG INC., Busan (KR)

( * ) Notice: Subject to any disclaimer, the term of this patent is extended or adjusted under 35 U.S.C. 154(b) by 335 days.

(21) Appl. No.: 16/675,749

(22) Filed: Nov. 6, 2019

(65) Prior Publication Data

US 2021/0002099 A1 Jan. 7, 2021

(30) Foreign Application Priority Data

Jul. 3, 2019 (KR) ..... 10-2019-0079746

(51) Int. Cl.
*B65H 75/26* (2006.01)

(52) U.S. Cl.
CPC ..... *B65H 75/26* (2013.01)

(58) Field of Classification Search
CPC ..... B65H 75/26; B65H 75/40; B65H 75/44; B65H 2701/36; A43C 7/08; A43C 11/008; A43C 11/00; A43C 11/14; A43C 11/16; A43C 11/165
See application file for complete search history.

(56) References Cited

U.S. PATENT DOCUMENTS

2018/0093852 A1* 4/2018 Morey ..... B65H 75/4434

FOREIGN PATENT DOCUMENTS

KR 10-1723579 B1 4/2017
KR 10-1810365 B1 12/2017

* cited by examiner

*Primary Examiner* — William A. Rivera
(74) *Attorney, Agent, or Firm* — Novick, Kim & Lee, PLLC; Jae Youn Kim

(57) ABSTRACT

A wire reel has a simplified wire joining structure in order to make manufacturing of the wire reel easy, which includes: a wire winding part having a wire wound surface on which a wire is wound by rotation, and first, second and third wire through holes formed in the wire wound surface to be spaced apart from one another at predetermined intervals so that the wire is inserted from the outside to the inside of a body; and a wire joining part having a wire joining groove formed in the body, a first direction joining area to which the wire is inserted from the outside to the inside of the body through the first wire through hole, a second direction joining area to which the wire is inserted from the inside to the outside of the body in the opposite direction to the first direction through the second wire through hole.

8 Claims, 17 Drawing Sheets

WIRE REEL

BACKGROUND OF THE INVENTION

Field of the Invention

The present invention relates to a wire reel, and more particularly, to a wire reel which has a simplified wire joining structure in order to make manufacturing of the wire reel easy.

Background Art

KR 10-1810365 discloses a wire reel and a wire joining structure which are easy to manufacture. However, the conventional wire joining structure has a disadvantage in that it is too complicated and it is difficult to manufacture.

PATENT LITERATURE

Patent Documents

Patent Document 1: Korean Patent No. 10-1810365 (entitled "wire reel and wire joining structure which are easy to manufacture")

Patent Document 2: Korean Patent No. 10-1723579 (entitled "wire tightening device")

SUMMARY OF THE INVENTION

Accordingly, the present invention has been made to solve the above-mentioned problems occurring in the prior arts, and it is an object of the present invention to provide a wire reel which can form a slope gradient along a central partition wall, thereby supporting wires entering in a second direction and preventing interference between wires when the wires are joined with each other.

Objects of the present invention are not limited to the objects described above, and other objects that are not described will be clearly understood by a person skilled in the art from the description below.

To accomplish the above object, according to the present invention, there is provided a wire reel including: a wire winding part having a wire wound surface on which a wire is wound by rotation, and first, second and third wire through holes formed in the wire wound surface to be spaced apart from one another at predetermined intervals so that the wire is inserted from the outside to the inside of a body; a wire joining part having a wire joining groove formed in the body, a first direction joining area to which the wire is inserted from the outside to the inside of the body through the first wire through hole, a second direction joining area to which the wire is inserted from the inside to the outside of the body in the opposite direction to the first direction through the second wire through hole, and a third direction joining area to which the wire is inserted from the outside to the inside of the body in the same direction as the first direction through the third wire through hole, wherein the wire is fixed and fastened in the wire joining groove; and a gear part having a gear protruding outwardly from the body so that the body is rotated by an interlinked operation of the gear.

Moreover, the wire joining groove is a horizontal groove formed to prevent interference due to movement of the wire passing the first, second and third direction joining areas.

Furthermore, the wire joining part includes: a first wire joining part for fixing and fastening one side of the wire; a second wire joining part for fixing and fastening the other side of the wire; and a central partition wall formed from one side to the other side of the wire joining groove to divisionally partition the first and second wire joining parts.

Additionally, the first wire joining part includes: a first wire joining groove which is formed at one side area on the basis of the central partition wall, is hollowed in the body, and has first, second and third direction joining areas; and a first inclined wall which is connected with the central partition wall and formed to guide the wire to enter the second direction joining area at a predetermined angle. In addition, the second wire joining part includes: a second wire joining groove which is formed at the other side area on the basis of the central partition wall, is hollowed in the body, and has first, second and third direction joining areas; and a second inclined wall which is connected with the central partition wall and formed to guide the wire to enter the second direction joining area at a predetermined angle.

Moreover, the first and second inclined walls are connected with the central partition wall and are shorter than the central partition wall to be as short as a predetermined length, so that the wire can be inserted into the second wire through hole when entering the second direction joining area.

Furthermore, the first and second inclined walls are inclined to be gradually lowered in height in the entering direction of the wire when the wire enters in the second direction.

Additionally, the first and second inclined walls are inclined to be relatively higher than the central partition wall and to gradually get higher in the entering direction of the wire, so that the wire is guided to enter in the direction of the second wire through hole.

In addition, each of the first and second inclined walls includes: a horizontal portion which is connected with the central partition wall and horizontally extends to be relatively lower in height; and an inclined portion which is connected with the central partition wall, extends from the horizontal portion, and is inclined so that the entire length is shorter than the central partition wall to be as short as a predetermined length.

Moreover, the inclined portion is shorter than the horizontal portion, so that the wire seated in the third direction joining area is fixed and fastened without interference by being pulled in the opposite direction to the entering direction of the wire entering in the first direction.

Furthermore, in another aspect of the present invention, there is a wire reel including: a first direction joining area to which a wire inserted from the outside to the inside of a body in a first direction through a first wire through hole; a second direction joining area formed in such a way that the wire goes out of the body through a second wire through hole in a second direction which is the opposite direction to the first direction, the second direction joining area guiding the wire to be inclinedly inserted before entering the second wire through hole while keeping the wire to a predetermined height from a wire joining groove formed in the body when the wire enters in the second direction; and a third direction joining area in which the wire inserted from the outside to the inside of the body through a third wire through hole in a third direction which is the same as the first direction is seated, wherein the wire seated in the third direction joining area is fixed and fastened without interference by being pulled in the opposite direction to the entering direction of the wire entering in the first direction since the wire is inclinedly inserted before entering the second wire through hole while keeping the predetermined height from the wire joining groove.

The wire reel according to the present invention can form a slope gradient along a central partition wall, thereby supporting wires entering in a second direction and preventing interference between wires when the wires are joined with each other.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, embodiments of the present invention will be described in detail with reference to the accompanying drawings. However, it will be understood by those skilled in the art that the embodiments described hereinafter does not unfairly limit the contents of the present invention described in claims and all components described in the embodiments may not be essential. Moreover, it will be also understood by those skilled in the art that matters, which are obvious to those skilled in the art and to prior arts, can be omitted, and omitted components (methods) and description of functions may be referred sufficiently within the range of the technical idea of the present invention.

Figure 1:
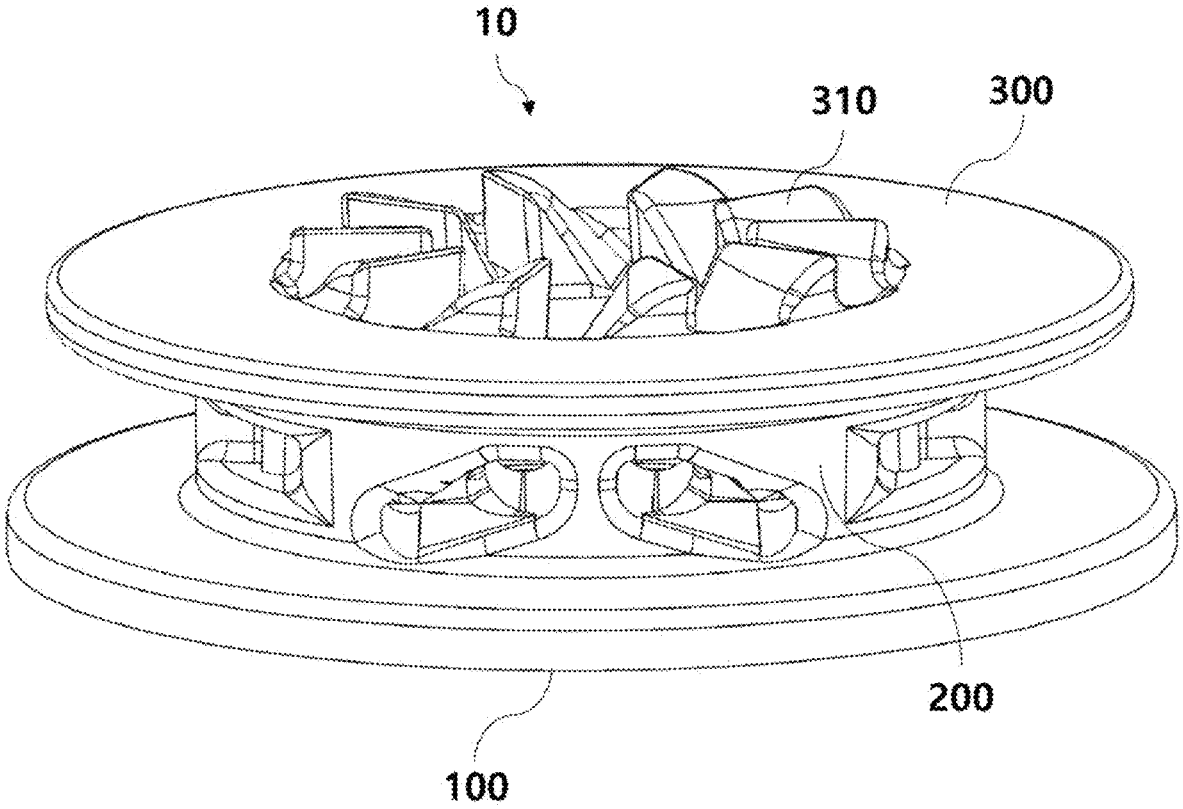
FIG. 1 is a view showing a gear part according to an embodiment of the present invention.

As shown in FIG. 1, a wire reel 10 according to an embodiment of the present invention is one among components of a shoe tightening device illustrated in the patent document of the patent literature, and is a device for winding a wire by rotation. The shoe tightening device may be referred in the patent literature within the range of the technical idea of the present invention. As shown in FIG. 1, the wire reel 10 includes a wire joining part 100, a wire winding part 200, and a gear part 300. The wire joining part 100, the wire winding part 200 and the gear part 300 are described separately just for the sake of convenient description, but it is preferable that they be formed integrally.

Figure 2:
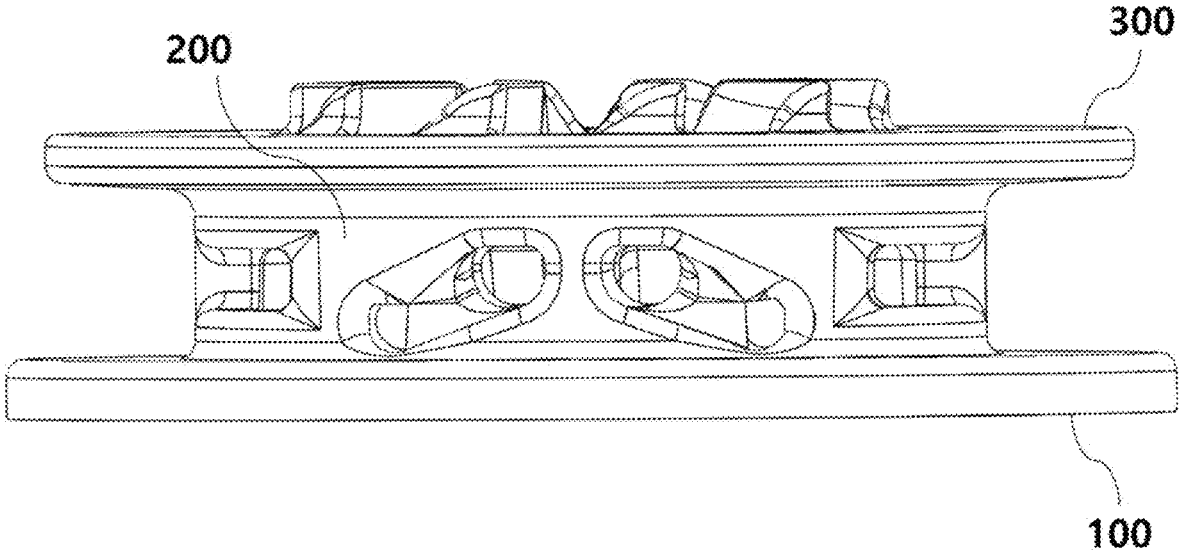
FIG. 2 is a view showing a wire winding part according to the embodiment of the present invention.

The gear part 300 is formed at a first side (or an upper side in FIGS. 1 and 2). The gear part 300 includes a gear 310 protruding outwardly. The gear 310 is gear-meshed with outer components and interlocked with the outer components so that the wire reel 10 is rotated.

Figure 3:
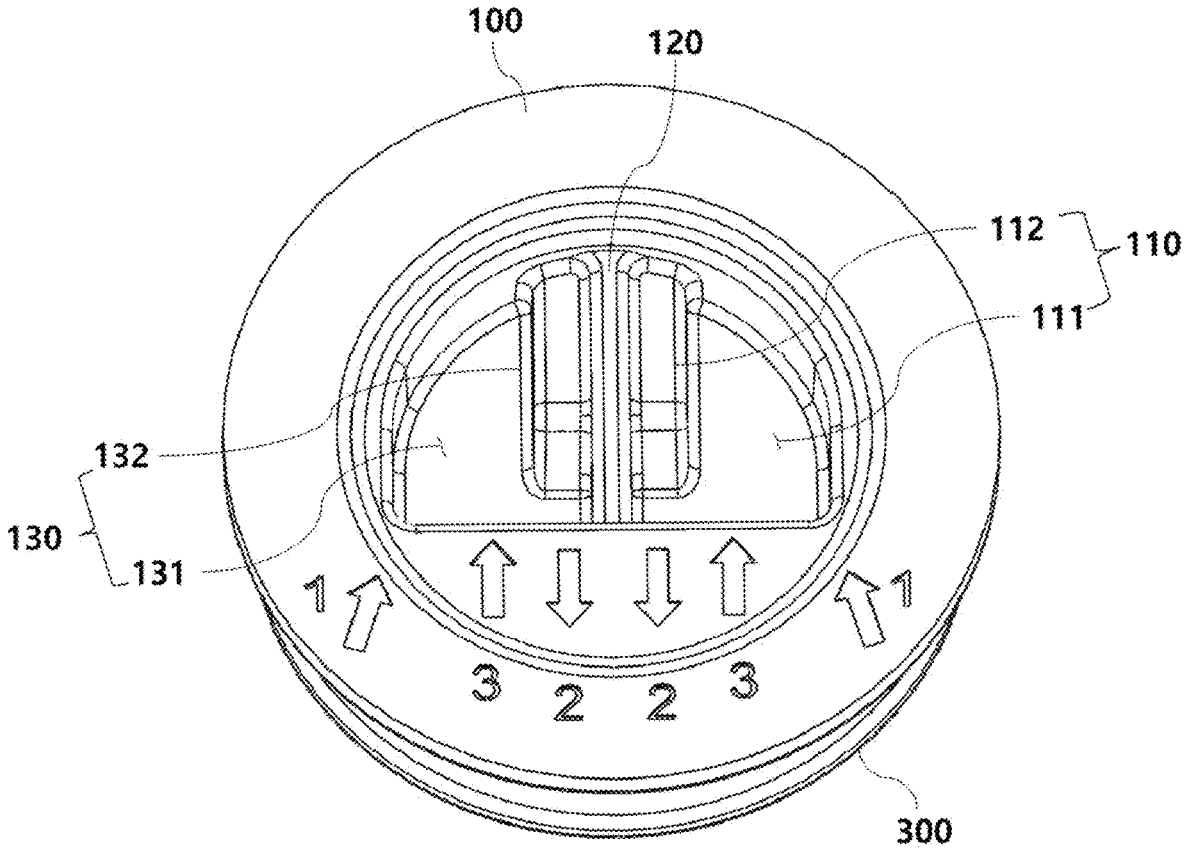
FIGS. 3 and 4 are views showing a wire joining part according to the embodiment of the present invention.

The wire joining part 100 is formed at a second side (or a lower side in FIGS. 1 and 2). As shown in FIGS. 3 to 7, the wire joining part 100 includes a first wire joining part 110, a central partition wall 120, and a second wire joining part 130. The first wire joining part 110 and the second wire joining part 130 are separated and partitioned from each other by the central partition wall 120. Referring to FIG. 3, the first wire joining part 110 is formed at the right and the second wire joining part 130 is formed at the left. The first wire joining part 110 fixes and fastens an end portion of one side of the wire, and the second wire joining part 130 fixes and fastens an end portion of the other side of the wire. The first wire joining part 110 and the second wire joining part 130 have the same shape and the same components. Therefore, hereinafter, only the first wire joining part 110 will be described and description of the second wire joining part 130 is substituted with the description of the first wire joining part 110.

The first wire joining part 110 includes a first wire joining groove 111 and a first inclined wall 112. As shown in FIG. 3, the first wire joining groove 111 is formed in a body 100. The first wire joining groove 111 is fixed and fastened while the wire 11 passes in first, second and third directions. Here, the first direction is a direction that the wire 11 is inserted from the outside to the inside of the body through a first wire through hole 211, and the second direction is a direction that the wire 11 inserted into the body goes out of the body, and the third direction is in the same orientation as the first direction.

Figure 4:
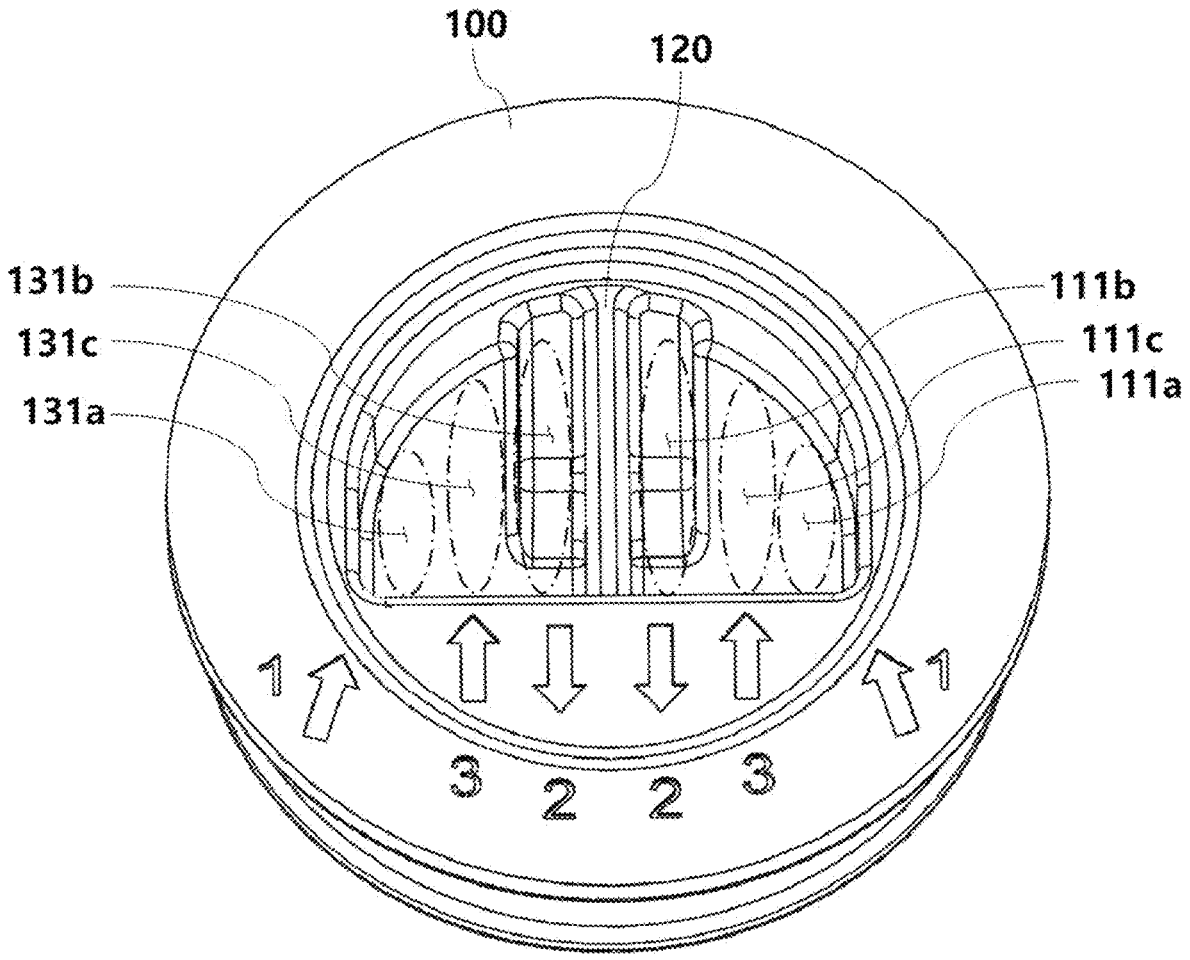
Figure 5:
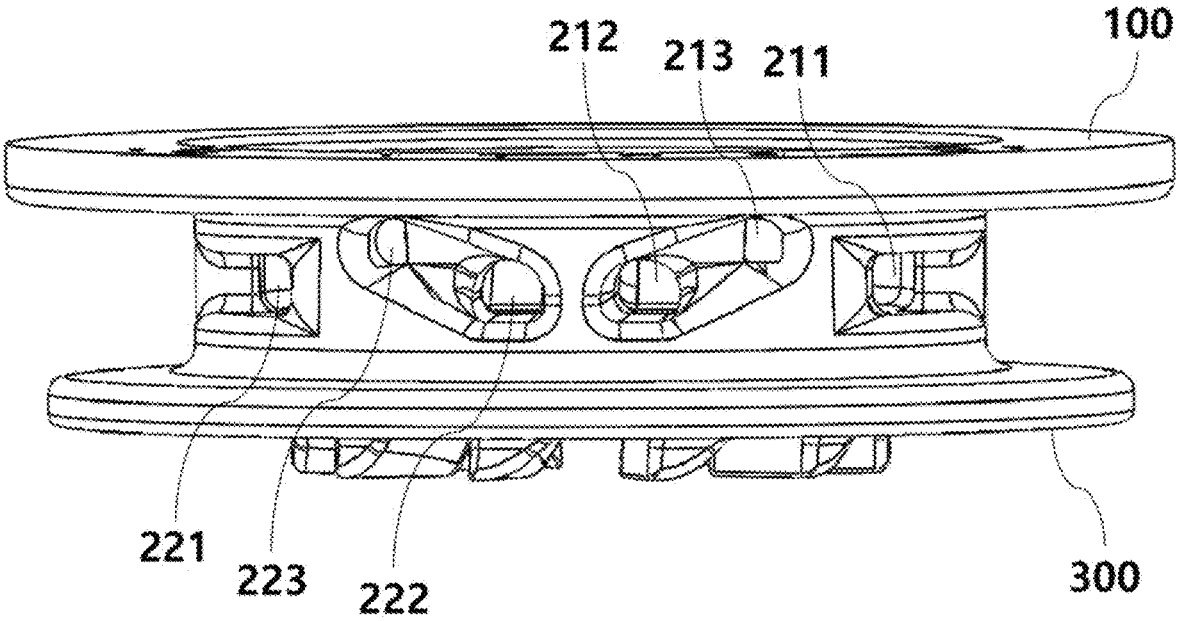
FIGS. 5 and 6 are views showing first, second and third wire through holes according to the embodiment of the present invention.
Figure 6:
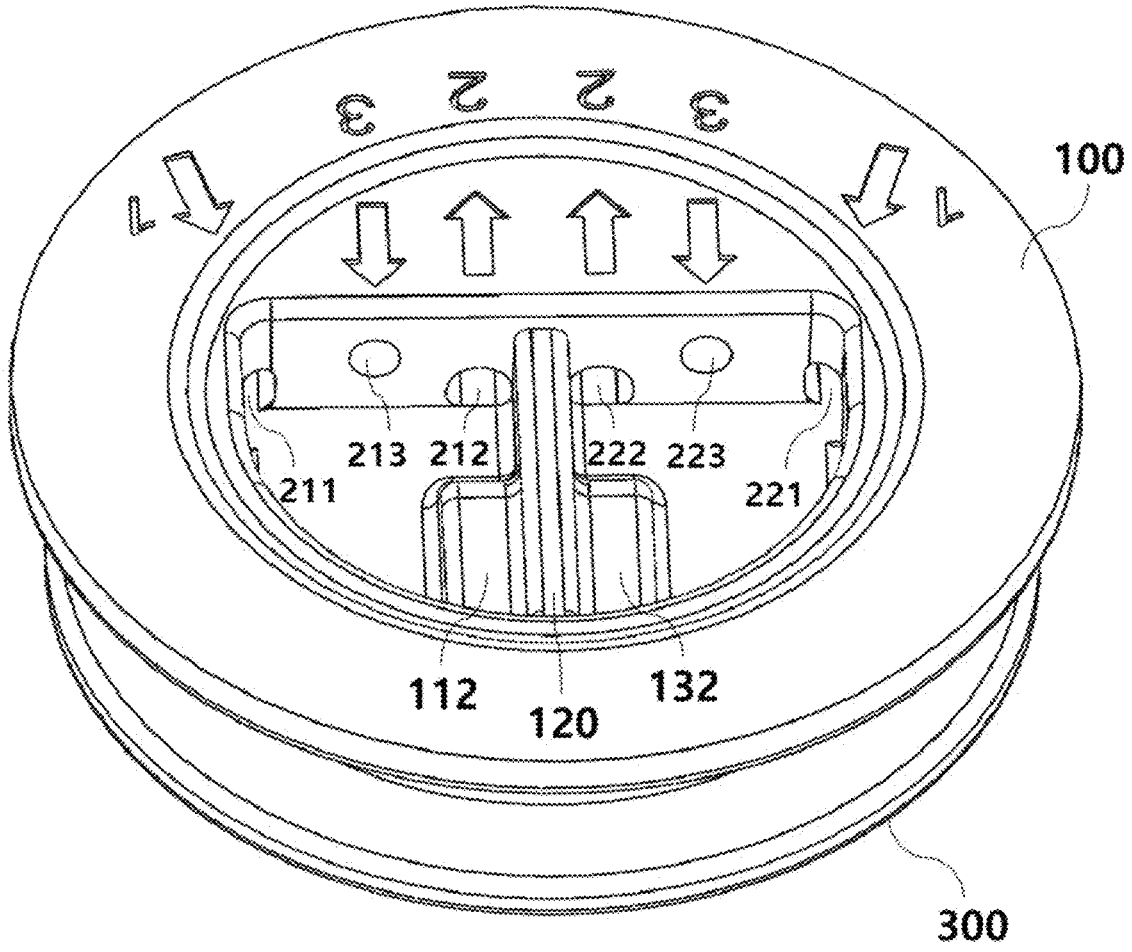

As shown in FIG. 4, first, second and third direction joining areas 111*a*, 111*b* and 111*c* may be formed virtually in an area of the first wire joining groove 111. The first direction joining area 111*a* is an area that the wire 11 is inserted and passes from the outside to the inside of the body, namely, the first direction, through the first wire through hole 211. The first direction joining area 111*a* is the uttermost area from the central partition wall 120. The second direction joining area 111*b* is an area that the wire passing the first direction joining area 111*a* goes out of the body through a second wire through hole 212 illustrated in FIG. 5, namely, in the second direction. The second direct joining area 111*b* is the closest area from the central partition wall 120. The third direction joining area 111*c* is an area that the wire is again inserted and goes from the inside and the outside of the body through a third wire through hole 213 illustrated in FIG. 5, namely, in the third direction. The third direction joining area 111*c* is a space formed between the first direction joining area 111*a* and the second direction joining area 111*b*. The third direction joining area 111*c* is an area that the end portion of the one side of the wire is fixed and fastened.

Figure 7:
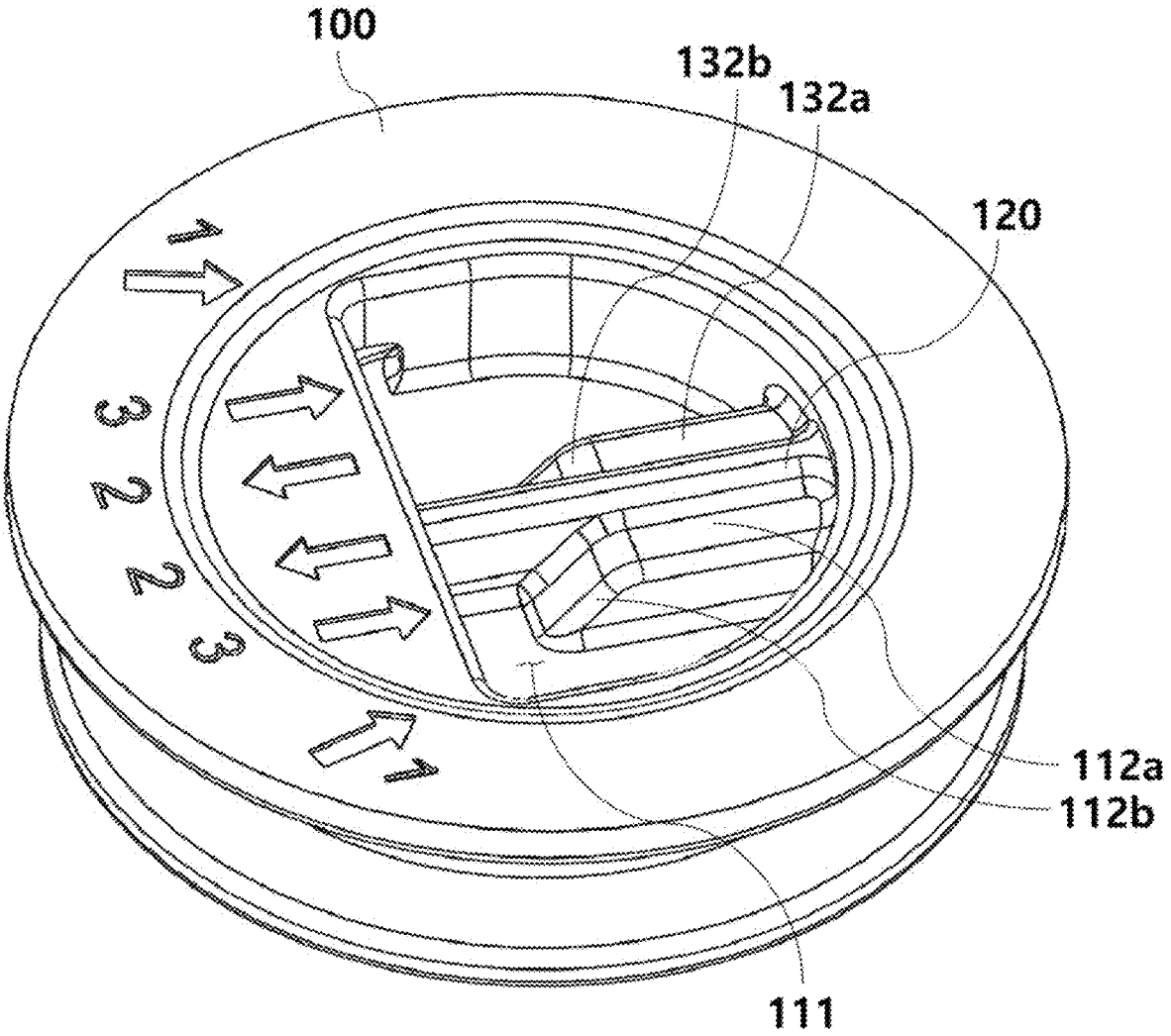
FIG. 7 is a view showing a horizontal portion and an inclined portion of first and second inclined walls according to the embodiment of the present invention.
Figure 13:
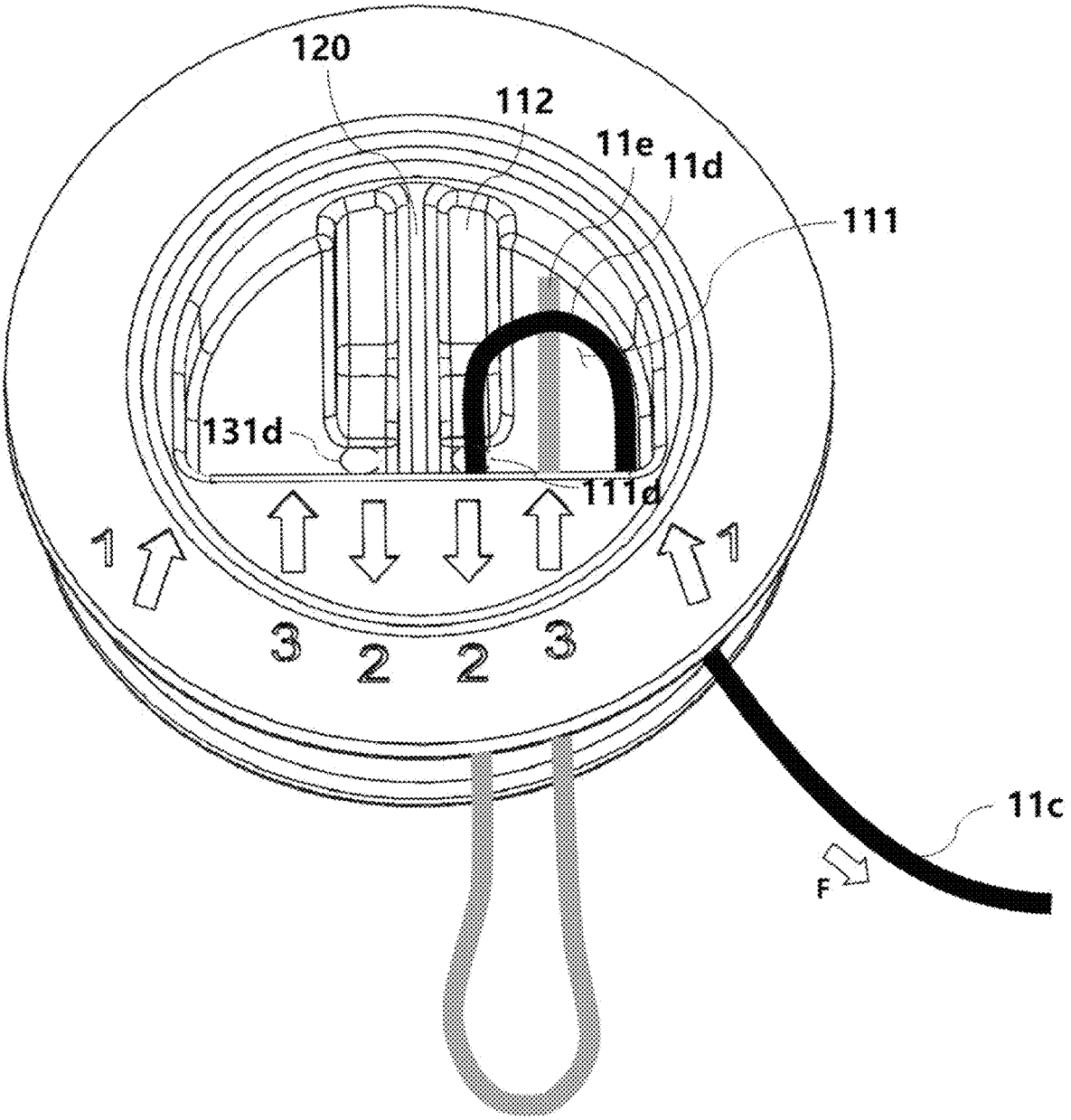

As shown in FIG. 7, the first inclined wall 112 guides the wire 11 entering the second direction joining area 111 to enter the second wire through hole 212 in order to prevent interference when the end portions of the wire are joined. Referring to FIG. 13, the prevention of interference will be described later. The first inclined wall 112 includes a horizontal portion 112*a* and an inclined portion 112*b*.

The horizontal portion 112*a* is connected with the central partition wall 120, extends in a longitudinal direction of the central partition wall 120, and is formed relatively lower than the central partition wall 120. Because the horizontal portion 112*a* is formed to be lower than the central partition wall 120, the wire 11 can be guided, but in this instance, the horizontal portion 112*a* may not guide the wire 11 well. Furthermore, it is preferable that the horizontal portion 112*a* be longer than the inclined portion 112*b* which will be described later.

The inclined portion 112*b* is connected with the central partition wall 120, extends from the horizontal portion 112*a* in the longitudinal direction of the central partition wall 120, and is preferably shorter than the horizontal portion 112*a*. The inclined portion 112*b* extends in the longitudinal direction of the central partition wall 120 to be inclined, and ends just before the second wire through hole 212, so that the entire length of the first inclined wall 112 becomes shorter than the central partition wall 120. Preferably, the length of the horizontal portion 112*a* is more than 50% of the entire length of the first inclined wall 112 so that the horizontal portion 112*a* does not interfere the wire seated in the third direction joining area when the end portion of the wire is fixed and fastened in the third direction joining area 111*c* (See FIG. 13). The horizontal portion 112*a* and the inclined portion 112*b* are described separately for the sake of convenient description, but it is preferable that they be formed integrally. The inclined portion 112*b* is formed to be gradually inclined from a point where the inclined portion 112*b* is connected with the horizontal portion 112*a* toward the second wire through hole 212.

The second wire joining part 130 is formed at the opposite side of the first wire joining part 110 to correspond to the first wire joining part 110. Detailed description of the second wire joining part 130 will be substitute with the description of the first wire joining part 110.

The central partition wall 120 is formed to divide the wire joining grooves 111 and 131 with approximately semicircular shape into two.

The wire winding part 200 is formed to wind wire between the wire joining part 100 and the gear part 300. A diameter of the gear part 300 selected at random is smaller than a diameter of the wire joining part 100 selected at random, a diameter of the wire winding part 200 selected at random is smaller than the diameter of the gear part 300, so that the wire can be wound along the circumferential surface. The first wire through hole 211 through which the wire first passes in the first direction is formed on the circumferential surface. Additionally, the second wire through hole 212 which is spaced apart from the first wire through hole 211 at a predetermined interval and through which the wire passes in the second direction is formed in the circumferential surface of the wire winding part 200. The third wire through hole 213 which is formed between the first wire through hole 211 and the second wire through hole 212 to be spaced apart from them and through which the wire passes in the third direction is formed in the circumferential surface. First, second and third wire through holes 221, 222 and 223 are formed to correspond to the first, second and third wire through holes 211, 212 and 213 based on the central partition wall 120. As described above, the wire is inserted into and passes through the first, second and third wire through holes 221, 222 and 223 in the first, second and third directions.

Hereinafter, a method for fixing and fastening the wire at the first and second wire joining grooves 111 and 131 will be described. Likewise, fastening of the wire at the second wire joining groove 131 is substituted with the joining method of the first wire joining groove 111.

Figure 8:
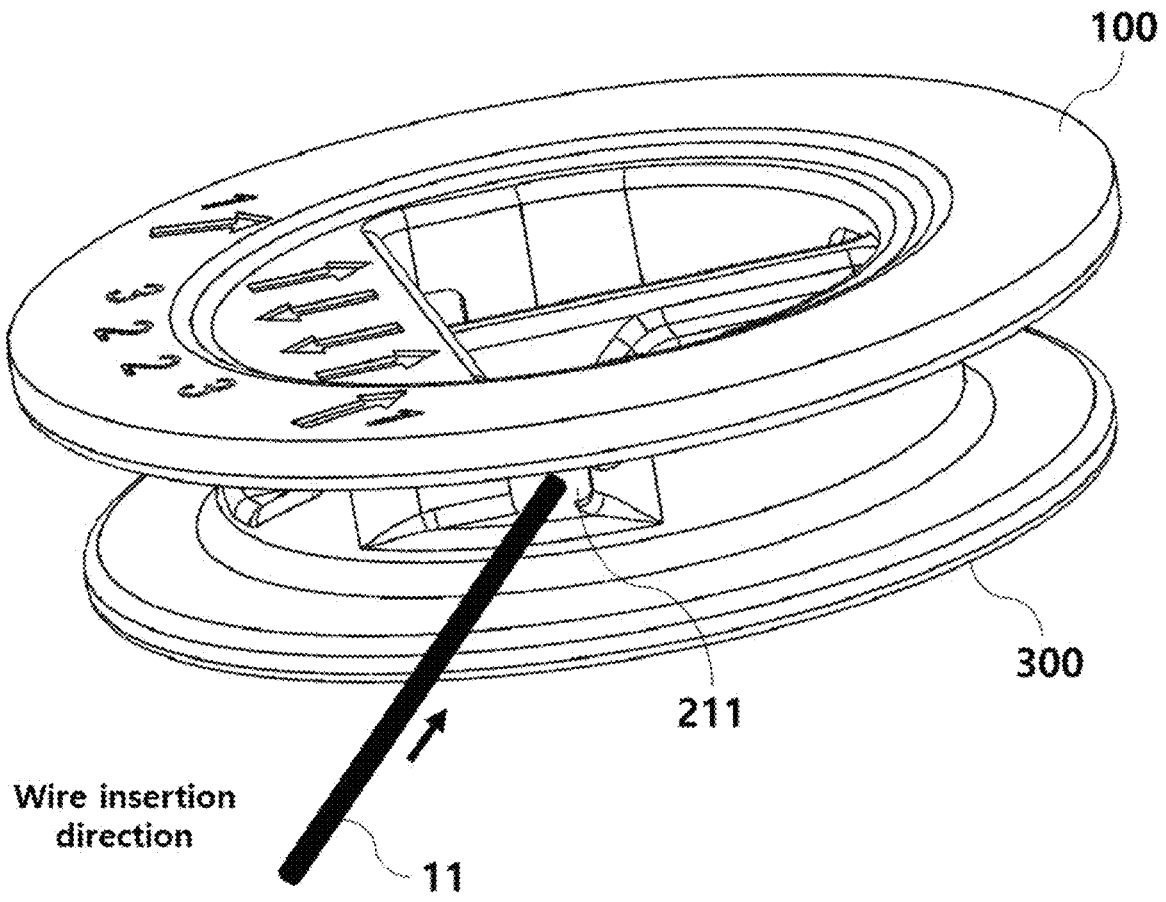
FIGS. 8 to 16 are views showing a wire inserting method in due order.
Figure 9:
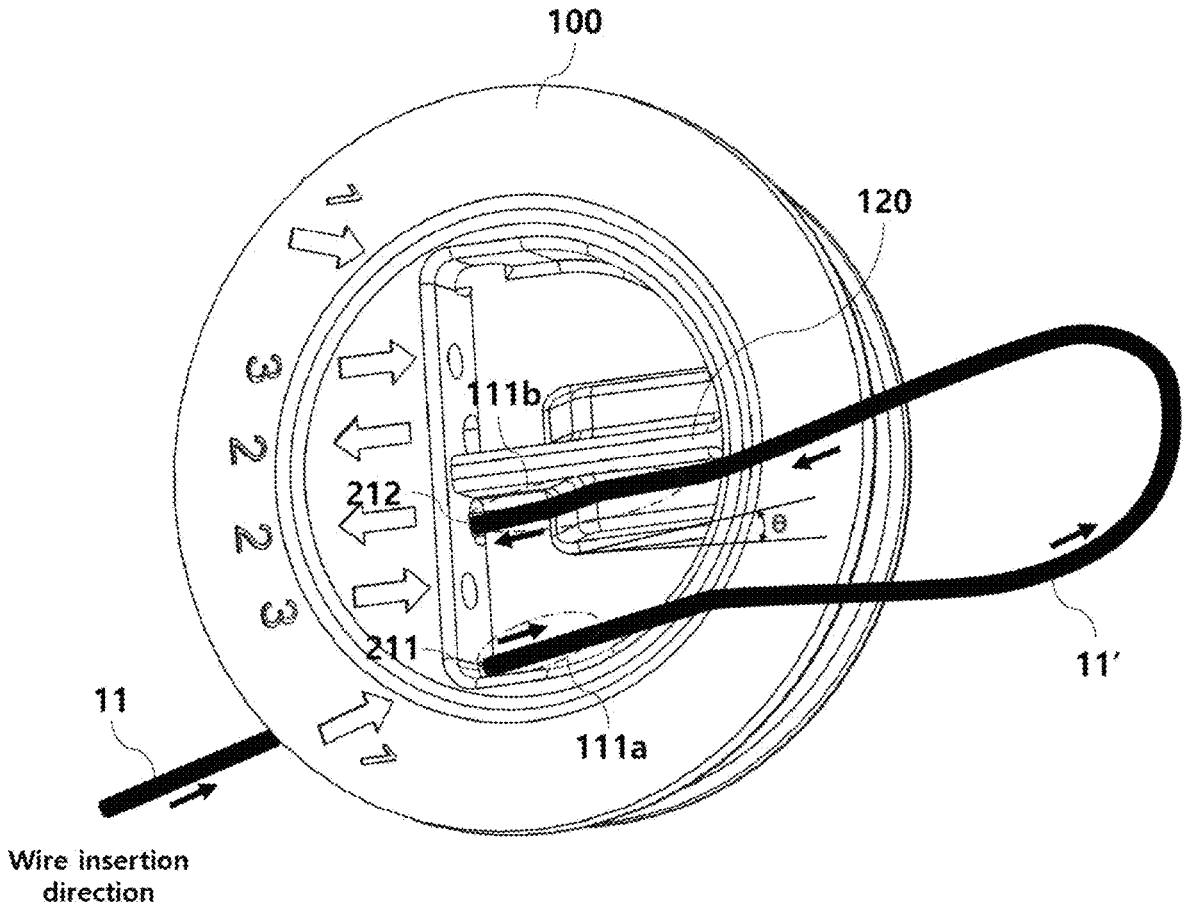

As shown in FIG. 8, the wire 11 is inserted from the outside to the inside of the body 100 through the first wire through hole 211, namely, in the first direction. As shown in FIG. 9, the wire 11 inserted in the first direction passes through the first direction joining area 111*a*, is bent to enter the second direction joining area 111*b*, and then, goes out of the body 100 through the second wire through hole 212, namely, in the second direction. In this instance, as shown in FIG. 9, the wire 11' is lifted at a predetermined angle θ by the first inclined wall 122.

Figure 10:
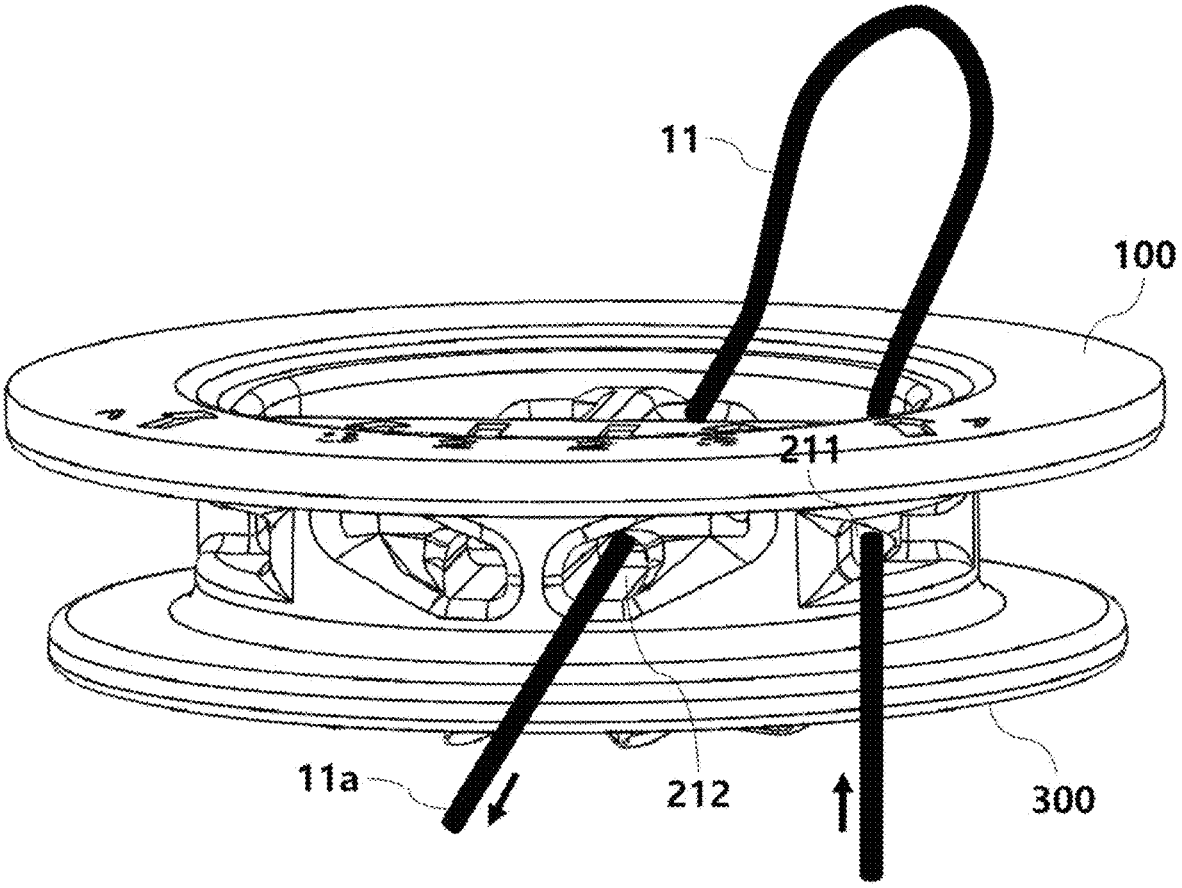
Figure 11:
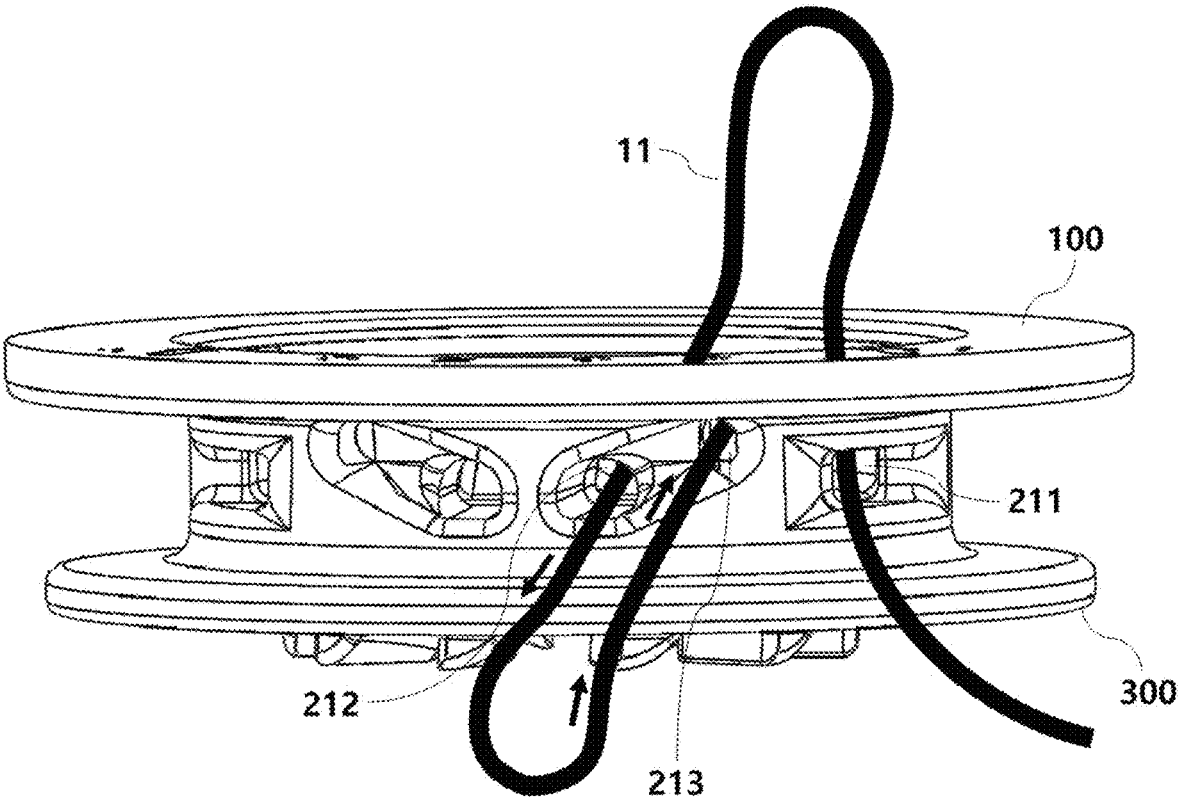
Figure 12:
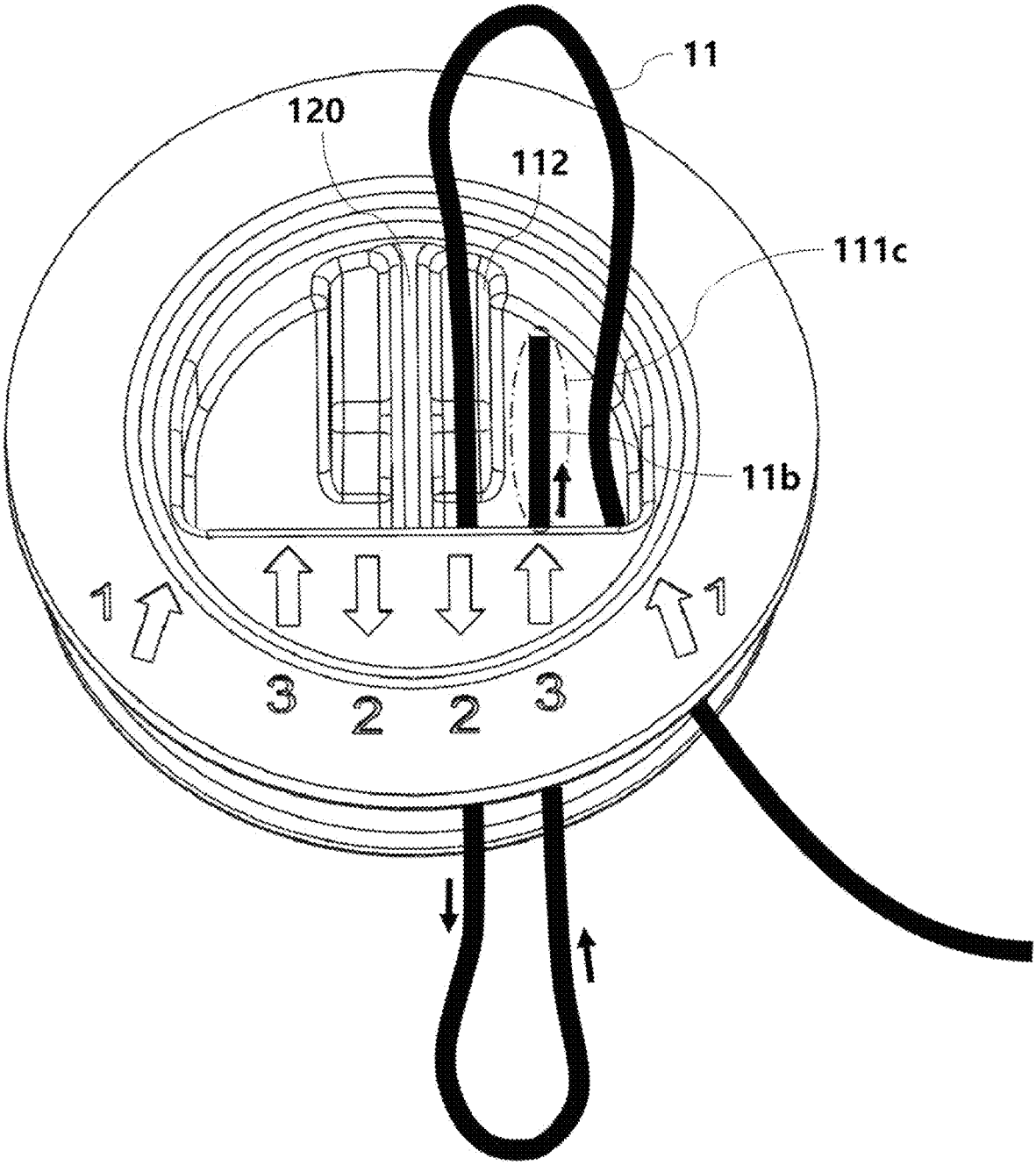

As shown in FIG. 10, the wire 11*a* going out of the body 100 through the second wire through hole 212 in the second direction is inserted again from the outside to the inside of the body 100 through the third wire through hole 213, namely, in the third direction. The end portion of the wire 11*b* inserted again through the third wire through hole 213 in the third direction is seated in the third direction joining area 111*c*.

As shown in FIG. 13, when a user pulls the wire 11*c* by an external force F, the wire is pulled while the length of the wire 11*d* is gradually reduced. In this instance, the wire 11*c* is pulled while the wire 11*d* is supported in a longitudinal wire support space 111*d* between the inclined portion 112*b* and the second wire through hole 212. Here, if the length of the inclined portion 112*d* of the first inclined wall 112 is longer, that is, if the length of the horizontal portion 112*a* is shorter than that of FIG. 13, an angle of the wire 11*d* (See FIG. 9) may be small, namely, the wire may lie more horizontally. If the angle of the wire 11*d* is small, the wire 11*d* is reduced since being pulled, and it is likely that the wire 11*d* interferes the wire 11*e*. Therefore, in this invention, it is preferable that the length of the horizontal portion 112*a* be longer than that of the inclined portion 112*b*.

Figure 14:
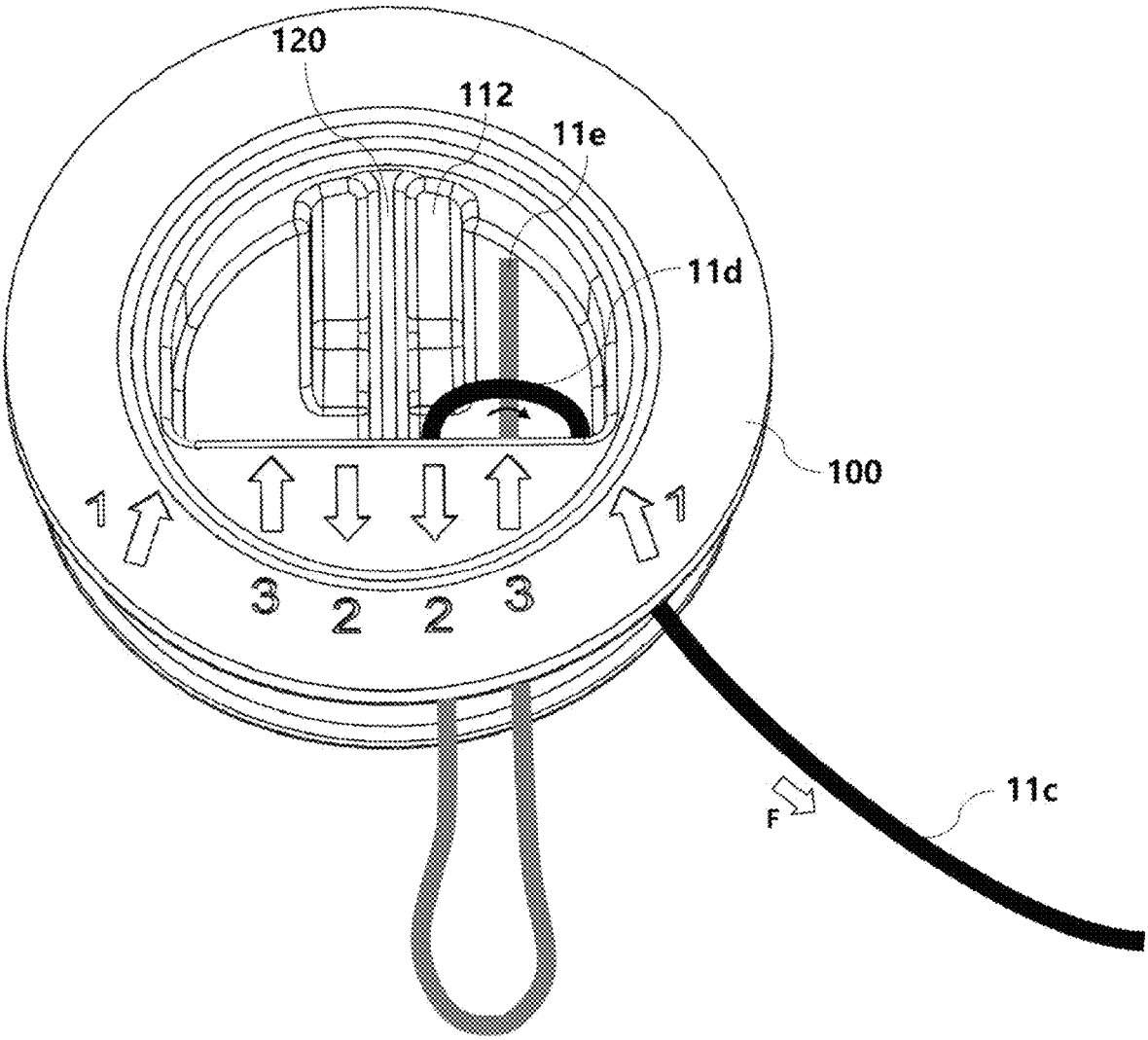
Figure 15:
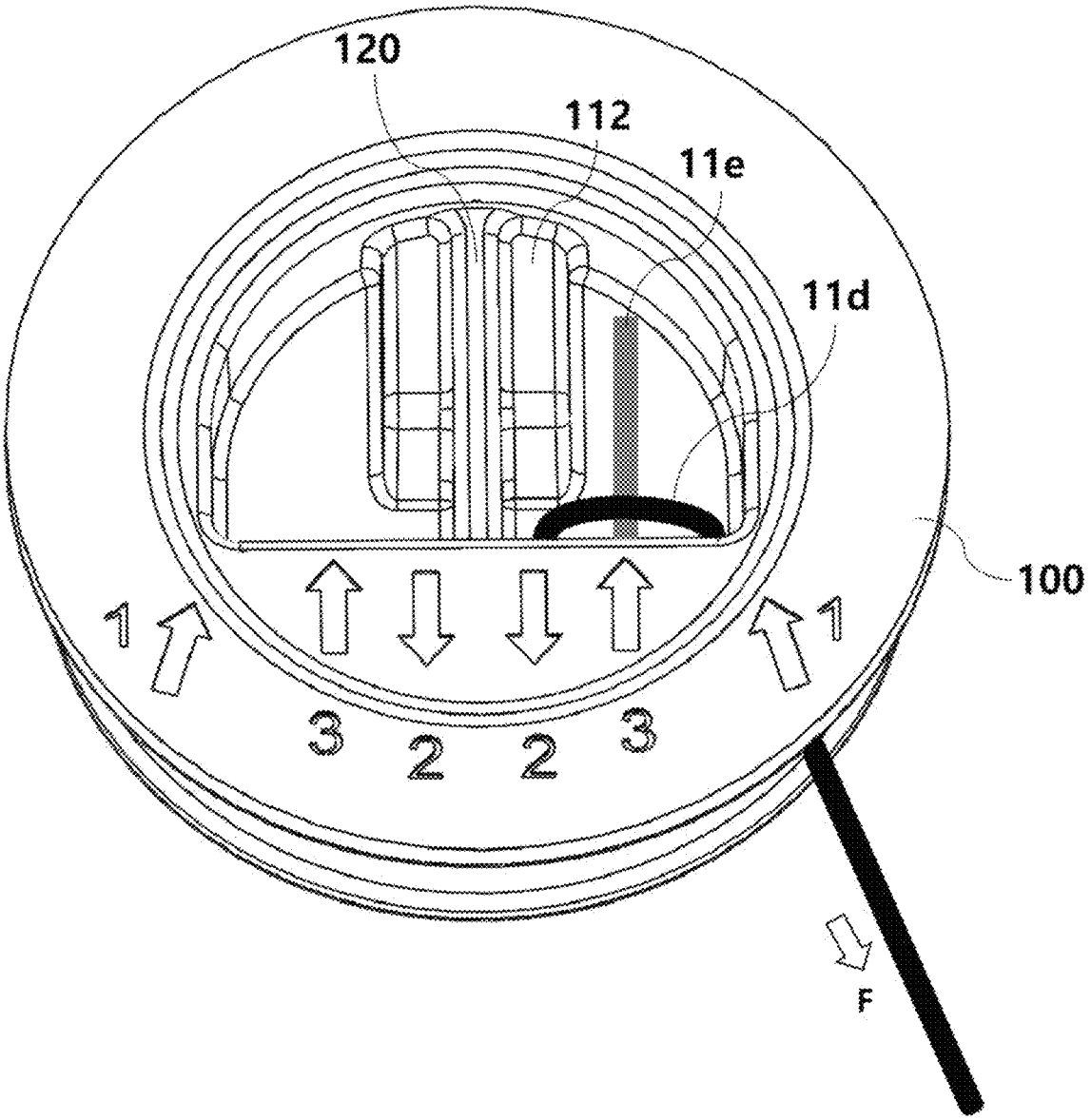
Figure 16:
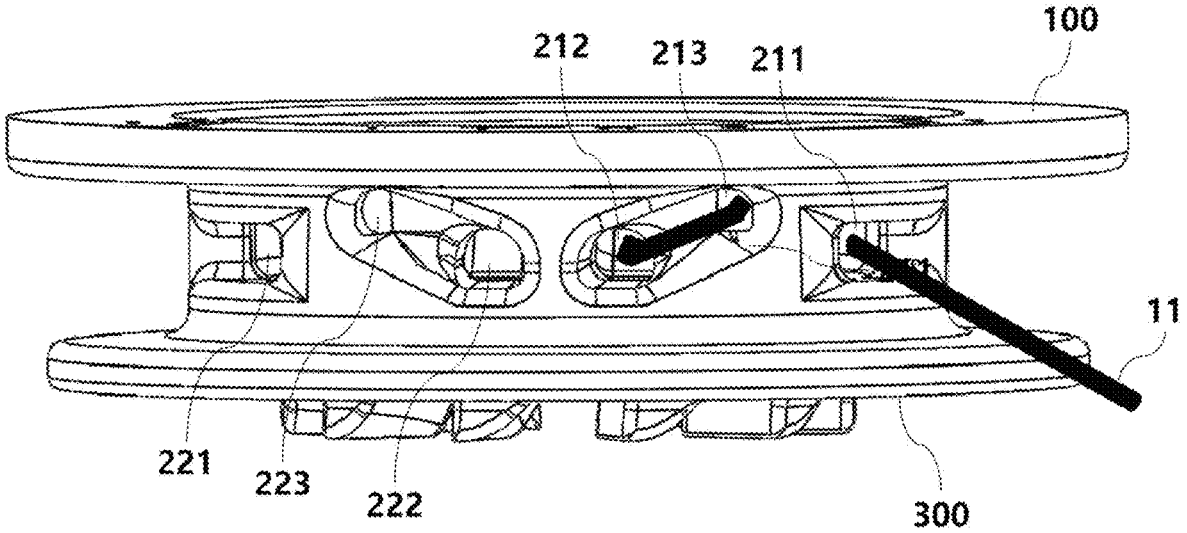

As shown in FIGS. 14 and 15, when the user continuously pulls the wire 11*c*, the wire 11*e* is pressed, fixed and fastened in the third direction joining area 111*c* by the wire 11*d*.

Figure 17:
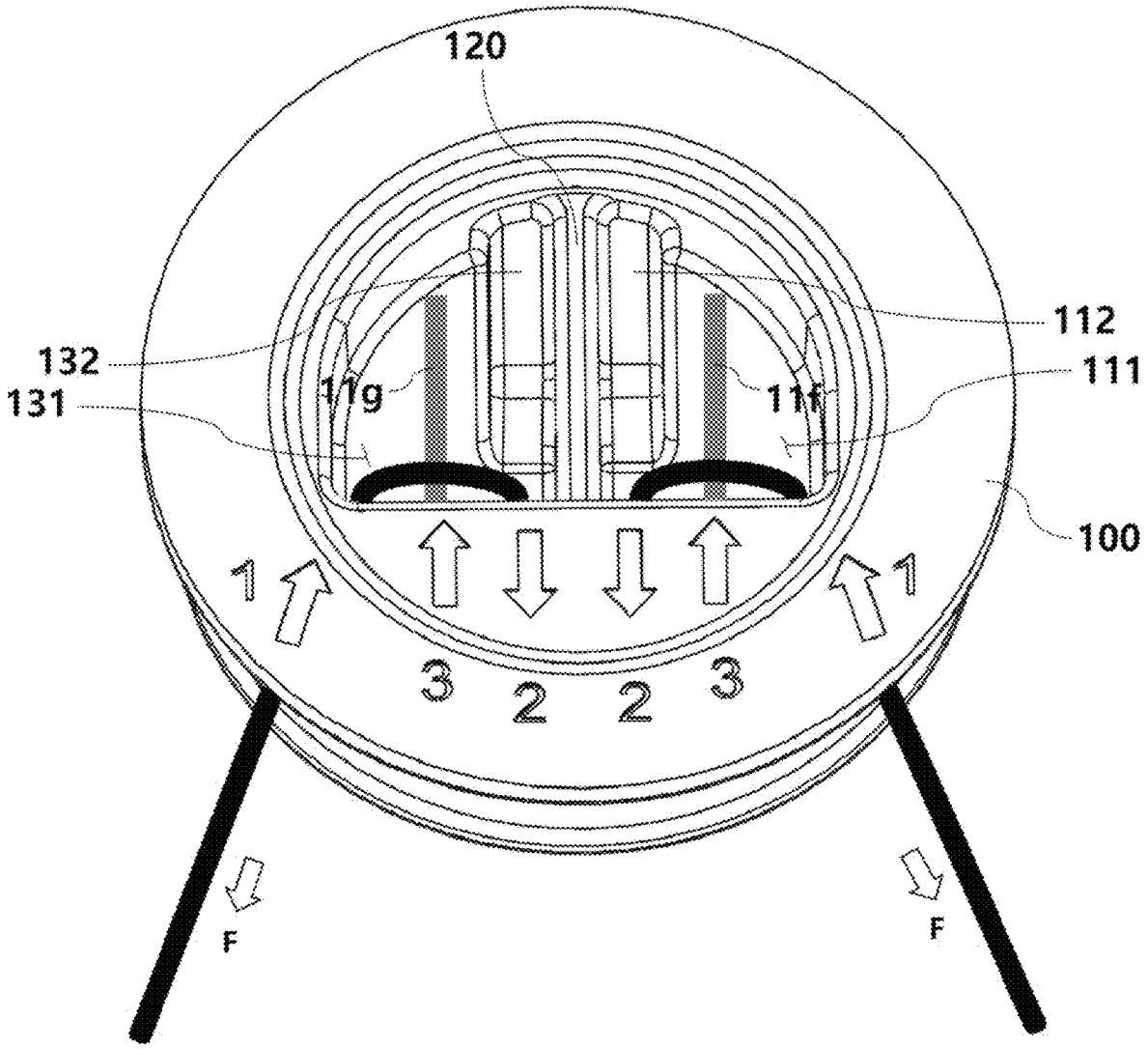
FIG. 17 is a view showing a wire of one end portion and a wire of the other end portion are all fixed and fastened according to the embodiment of the present invention.

A first end portion 11*f* of the wire 11 is fixed and fastened in the first wire joining groove 111, and as shown in FIG. 17, a second end portion 11*g* of the wire 11 is fixed and fastened in the second wire joining groove 131.

It will be understood by those skilled in the art that matters, which are obvious to those skilled in the art and to prior arts, can be omitted, and omitted components (methods) and description of functions may be referred sufficiently within the range of the technical idea of the present invention. Additionally, it will be also understood by those of ordinary skill in the art that the components described above are provided just for the sake of convenient description and other components which are not described may be added within the range of the technical idea of the present invention.

Moreover, it will be also understood by those of ordinary skill in the art that the components and functions of the parts are described separately, but any one of the components and functions may be integrated with another component or may be subdivided.

While the present invention has been particularly shown and described with reference to the example embodiments thereof, it will be appreciated that the present invention is not limited thereto, and various changes, modifications and equivalents may be made in the present invention. That is, it will be understood by those of ordinary skill in the art that various changes and modifications of the present invention are possible without departing from the technical scope and idea of the present invention. In addition, when it is judged that detailed descriptions of known functions or structures related with the present invention or detailed descriptions of combination relations of components of the present invention may make the essential points vague, the detailed descriptions of the known functions or structures will be omitted.

What is claimed is:

1. A wire reel comprising:

a wire winding part having a wire wound surface on which a wire is woundable by rotation, and first, second and third wire through holes formed in the wire wound surface to be spaced apart from one another at predetermined intervals so that the wire is insertable from an outside to an inside of a body;

a wire joining part having a wire joining groove formed in the body, a first direction joining area to which the wire is insertable from the outside to the inside of the body through the first wire through hole, a second direction joining area to which the wire is insertable from the inside to the outside of the body in the opposite direction to the first direction through the second wire through hole, and a third direction joining area to which the wire is insertable from the outside to the inside of the body in the same direction as the first direction through the third wire through hole, wherein the wire joining groove is configured to fix the wire therein; and a gear part having a gear protruding outwardly from the body so that the body is rotatable by an interlinked operation of the gear, wherein the wire joining groove is a horizontal groove, and wherein the wire joining part comprises:

a first wire joining part for fixing one side of the wire;

a second wire joining part for fixing another side of the wire; and a central partition wall formed from one side to another side of the wire joining groove to divisionally partition the first and second wire joining parts.

2. The wire reel according to claim 1, wherein the wire joining groove is formed to prevent interference due to movement of the wire passing the first, second and third direction joining areas.

3. The wire reel according to claim 2, wherein the first wire joining part comprises:

a first wire joining groove which is formed at one side area on the basis of the central partition wall, is hollowed in the body, and has first, second and third direction joining areas; and a first inclined wall which is connected with the central partition wall and formed to guide the wire to enter the second direction joining area at a predetermined angle, and wherein the second wire joining part comprises:

a second wire joining groove which is formed at another side area on the basis of the central partition wall, is hollowed in the body, and has first, second and third direction joining areas; and a second inclined wall which is connected with the central partition wall and formed to guide the wire to enter the second direction joining area at a predetermined angle.

4. The wire reel according to claim 3, wherein the first and second inclined walls are connected with the central partition wall and is shorter than the central partition wall to be as short as a predetermined length, so that the wire can be inserted into the second wire through hole when entering the second direction joining area.

5. The wire reel according to claim 4, wherein the first and second inclined walls are inclined to be gradually lowered in height in the entering direction of the wire when the wire enters in the second direction.

6. The wire reel according to claim 5, wherein the first and second inclined walls are inclined to be relatively higher than the central partition wall and to gradually get higher in the entering direction of the wire, so that the wire is guidable to enter in the direction of the second wire through hole.

7. The wire reel according to claim 6, wherein each of the first and second inclined walls comprises:

a horizontal portion which is connected with the central partition wall and horizontally extends to be relatively lower in height; and an inclined portion which is connected with the central partition wall, extends from the horizontal portion, and is inclined so that the entire length is shorter than the central partition wall to be as short as a predetermined length.

8. The wire reel according to claim 7, wherein the inclined portion is shorter than the horizontal portion, so that the wire seated in the third direction joining area can be fixed and fastened without interference by being pulled in the opposite direction to the entering direction of the wire entering in the first direction.

* * * * *